US010658165B2

(12) United States Patent
Pfaff et al.

(10) Patent No.: US 10,658,165 B2
(45) Date of Patent: May 19, 2020

(54) ISOTOPIC PATTERN RECOGNITION

(71) Applicant: Thermo Fisher Scientific (Bremen) GmbH, Bremen (DE)

(72) Inventors: Hans Pfaff, Bremen (DE); Timothy J. Stratton, Sunnyvale, CA (US)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/298,612

(22) Filed: Jun. 6, 2014

(65) Prior Publication Data

US 2014/0361159 A1 Dec. 11, 2014

(30) Foreign Application Priority Data

Jun. 7, 2013 (GB) ..... 1310174.6

(51) Int. Cl.
*H01J 49/00* (2006.01)
*H01J 49/26* (2006.01)

(52) U.S. Cl.
CPC ..... *H01J 49/0036* (2013.01); *H01J 49/26* (2013.01)

(58) Field of Classification Search
None
See application file for complete search history.

(56) References Cited

U.S. PATENT DOCUMENTS 7,189,964 B2 3/2007 Castro-Perez et al.
7,381,568 B2 6/2008 Zhang et al.
7,634,364 B2 12/2009 Chen et al.
8,063,357 B2 11/2011 Castro-Perez et al.
8,237,106 B2 8/2012 Castro-Perez et al.
8,330,101 B2 12/2012 Seyfarth
(Continued)

FOREIGN PATENT DOCUMENTS

CN 102129949 A 7/2011
EP 1770779 A2 4/2007
(Continued)

OTHER PUBLICATIONS

Roussis, S. G., et al. Reduction of Chemical Formulas from the Isotopic Peak Distributions of High-Resolution Mass Spectra, 2003, Analytical Chemistry, vol. 75, pp. 1470-1482.*
(Continued)

*Primary Examiner* — Xiaoyun R Xu
(74) *Attorney, Agent, or Firm* — Thomas F. Cooney; Nicholas Cairns

(57) ABSTRACT

A measure of abundance is determined for an element or element combination within a sample, the element or element combination having at least one isotopic variant. An isotopic mass spectral pattern is identified for the element or element combination that indicates an expected abundance and expected mass-to-charge ratio difference for each isotopic variant. These are identified relative to the respective abundance and mass-to-charge ratio of a principal isotope. The isotopic mass spectral pattern is compared with mass spectral data from a molecular mass analysis of the sample to identify peak groups, each matching the isotopic mass spectral pattern. A measure of abundance is determined for the element or element combination as a function of the intensity measurement of one or more peaks from each of the identified peak groups.

14 Claims, 7 Drawing Sheets

(56) References Cited

U.S. PATENT DOCUMENTS

| | | | | |
|---|---|---|---|---|
| 2007/0114373 | A1* | 5/2007 | Zweigenbaum .... | H01J 49/0036 250/282 |
| 2009/0154425 | A1 | 6/2009 | Patil et al. | |

FOREIGN PATENT DOCUMENTS

| | | | | |
|---|---|---|---|---|
| EP | 2128791 | A2 | 12/2009 | |
| EP | 2322922 | A1 | 5/2011 | |
| WO | WO 2005/009039 | A2 | 1/2005 | |
| WO | WO 2006/050226 | A2 | 5/2006 | |
| WO | WO 2008/151153 | A1 | 12/2008 | |
| WO | WO2010025834 | A1 | 3/2010 | |
| WO | WO 2012/175517 | * | 12/2012 | ..... H01J 49/00 |

OTHER PUBLICATIONS

Watson, J.T., et al. Introduction to Mass Spectrometry: Instrumentation, Applications and Strategies for Data Interpretation, Fourth Edition, 2008, John Wiley & Sons, Ltd. ISBN: 978-0-470-51634-8.*

Stoll, N. et al. Isotope Pattern Evaluation for the Reduction of Elemental Compositions Assigned to High-Resolution Mass Spectral Data from Electrospray Ionization Fourier Transform, Journal of American Society Mass Spectrom, vol. 17, pp. 1692-1699 (Year: 2006).*

Li, L. et al. Memory-efficient calculation of the isotopic mass states of a molecule, Rapid Communications in Mass Spectrometry, vol. 24, pp. 2689-2696 (Year: 2010).*

Chernushevich, et al., "An introduction to quadrupole-time-of-flight mass spectrometry," J. Mass Spectrom. 2001, 36, pp. 849-865.

Drexler, et al., "Automated Identification of Isotopioally LabeledPesticides and Metabolites by Intelligent 'Real Time' Liquid Chromatography Tandem Mass Spectrometry using a Bench-top Ion Trap Mass Spectrometer," Rapid Commun. Mass Spectrom. 12, (1998), pp. 1501-1507.

Stoll, et al., "Isotope Pattern Evaluation for the Reduction of Elemental Compositions Assigned to High-Resolution Mass Spectral Data from Electrospray Ionization Fourier Transform Ion Cyclotron Resonance Mass Spectrometry," J Am Soc Mass Spectrom 2006, 17, pp. 1692-1699.

Robert J. Anderegg, "Selective Reduction of Mass Spectral Data by Isotope Cluster Chromatography," Analytical Chemistry (1981), vol. 53 (No. 14), pp. 2169-2171.

* cited by examiner

ISOTOPIC PATTERN RECOGNITION

TECHNICAL FIELD OF THE INVENTION

The invention relates to a method and system for determining a measure of abundance for an element or element combination within a sample, the element or element combination having at least one isotopic variant.

BACKGROUND TO THE INVENTION

Mass spectrometry can be used for qualitative and quantitative identification of compounds in a wide variety of samples, including metabolomics, proteomics, pesticide analysis, natural substance identification, pharmaceuticals and comparable fields. Liquid Chromatography-Mass Spectrometry (LC/MS) is particularly used in such analyses.

In this area, the recognition of isotopic patterns is often considered useful. The control of a mass spectrometer based on detected isotopic fingerprints (patterns in the mass spectrum) is also known. Examples of this are shown in: Drexler, D. M. et al., "Automated Identification of Isotopically Labeled Pesticides and Metabolites by Intelligent 'Real Time' Liquid Chromatography Tandem Mass Spectrometry using a Bench-top Ion Trap Mass Spectrometer", Rapid Commun. Mass Spectrom., 1998, 12, 1501-1507; Chernushevich, I. V. et al., "An introduction to quadrupole-time-of-flight mass spectrometry", J. Mass Spectrom., 2001, 36, 849-865; Lock C. et al., "ICAT Labeled Protein Analysis via Automated Liquid Chromatography/Orthogonal MALDI QqTof", Proceedings of the 49th ASMS Conference on Mass Spectrometry and Allied Topics, May 27-31, 2001; and U.S. Pat. No. 7,189,964.

These techniques often rely on strong isotopic signals from components like Chlorine or Bromine, where the contribution to the overall isotopic pattern from heavy isotopes is significant (>30% for chlorine and >80% for bromine). Without high resolution, it becomes difficult to separate fine structure in the spectrum. Fine structure here can be defined as the ability to separate the members of the nominal parts of the isotopic pattern ($A_1$, $A_2$, $A_3$. etc.) into their constituent parts, which are contributed by the specific atoms that make up the observed species. The small mass differences in the isotopes of carbon, hydrogen, nitrogen, oxygen, sulphur, chlorine, bromine and other atoms and their abundances (either natural or artificial) are the source of this fine isotopic structure.

High resolution mass spectrometry is commonly used for quantitation of pollutants. This may be performed using double-focusing sector mass spectrometry, for example. The high resolution can differentiate between peaks from different sources having the same nominal mass. An example of this is shown in WO2010/025834, having common ownership with this invention.

More recent developments have begun to use high resolution mass spectrometry to overcome the difficulties in recognising isotopic patterns. EP 2 128 791 discusses the comparison of isotopic patterns with simulated isotope patterns, in order to guide an analysis of elemental composition. Stoll, N. et al., "Isotope Pattern Evaluation for the Reduction of Elemental Compositions Assigned to High-Resolution Mass Spectral Data from Electrospray Ionization Fourier Transform Ion Cyclotron Resonance Mass Spectrometry", J. Am. Soc. Mass Spectrom., 2006, 17, p. 1692-1699 discusses the use of isotopic fine structure for pruning of elemental composition candidate lists (see especially FIGS. 4 and p. 1696, col. 2). Also, quantitative isotopic fine structure analysis is also known in isotope ratio analysis, although dominantly with the goal of avoiding interferences. This is shown in EP 1 770 779, especially for geological applications.

For detection of metabolites, a so-called "mass defect analysis" or "Kendrick mass analysis" is frequently used. Various aspects of this method are discussed in U.S. Pat. Nos. 8,237,106, 8,063,357, 7,634,364 and 7,381,568. Essentially, by identifying ions with a certain class of exact mass defects, it is expected to catch metabolic derivatives of particular known substances. These methods directly use a single exact mass for identification of members of a substance class.

All of these approaches (but especially the isotopic fingerprinting approach and the approach for filtering by "mass defect") are focussed on identification of the complete elemental composition of a compound, molecule or fragment. Whilst the mass defect approach can identify the presence of a single functional group, this is still limited to analysis of individual molecules. An analysis that considers the entire mass spectrum is significantly more difficult.

SUMMARY OF THE INVENTION

Against this background, the present invention provides a method for determining a measure of abundance for an element or element combination within a sample, the element or element combination having at least one isotopic variant. The method comprises: identifying an isotopic mass spectral pattern for the element or element combination, the isotopic mass spectral pattern indicating an expected abundance and expected mass-to-charge ratio difference for each of one or more isotopic variants, the expected abundance and expected mass-to-charge ratio difference being identified relative to the respective abundance and mass-to-charge ratio of a principal isotope of the element or element combination; comparing the isotopic mass spectral pattern with mass spectral data from a molecular mass analysis of the sample, the mass spectral data comprising a plurality of peaks, each peak indicating an intensity measurement for a respective mass-to-charge ratio, wherein the comparing identifies a plurality of peak groups each matching the isotopic mass spectral pattern; and determining a measure of abundance for the element or element combination as a function of the intensity measurement of one or more peaks from each of the identified plurality of peak groups.

Thus, the invention can provide a general, efficient and reliable method for identifying members of a certain substance class in large data sets. Detecting components in a complex stream of mass spectrometry data can be achieved (at least in part) by the application of an isotopic search that utilizes the fine isotopic pattern available from very high resolution measurements. High (>50000, 70000 or 100000 Resolving Power, RP, at mass 400, for instance) or ultra high resolution (>150000, 200000, 240000 RP at mass 400, for instance) and accurate mass (<3 ppm with external calibration, for example) measurements can be achieved. Fine isotopic pattern recognition can then be a powerful tool to confirm and aid in small molecule identification. The principal isotope is typically the most abundant, but need not necessarily be so. In some cases, it may be the isotope with the lowest mass. Instead of achieving a true "molecular" fingerprint, the invention analyses the fine structure to identify peak groups that are characteristic of a certain element. It may eliminate the subtleties and difficulties associated with trying to group peaks together in conventional techniques.

The desired resolution may depend upon the element or element combination (such as a functional group, for instance several elements in a fixed quantity, or characteristic pair, for instance $^{13}C+^{15}N$ or similar) that is to be investigated and other (possibly interfering) elements present in the sample. The specific pattern may be the result of one or more elements contributing to the overall observed pattern. Additionally or alternatively, the specific pattern can be the result of natural abundances or artificially induced abundances (for example, by stable or radio labelling of compounds). In a variation on the invention, the step of comparing may identify a single peak group matching the isotopic mass spectral pattern; and the step of determining a measure of abundance for the element or element combination may be carried out as a function of the intensity measurement of one or more peaks from the identified peak group.

The invention may be applicable for targeted and untargeted qualitative identification of compounds in a wide variety of samples including metabolomics, proteomics, pesticide analysis, natural substance identification, pharmaceuticals and comparable fields.

In terms of fine structure, existing approaches have tended to avoid analysis of anything other than the principal isotope. High resolution mass analysis may improve the level of fine structure that can be identified. High resolution may be understood by reference to the number of significant figures after the decimal point in the m/z (for example, at least 4). Typically, a resolving power of 70000 is desirable, 200000 is preferable (for example, for 15 separating N and $^{13}C$ on the $A_1$ position) and 250000 RP (all at m/z 400) is more preferable (which may be enough to completely resolve isotopic fine structure in most "small molecules" of mass 50 to 600 Da). However, optionally a resolving power (at m/z 400) of at least one of: 30000; 50000; 70000; 100000; 150000; 200000; 250000; and 300000 is considered. Suitable mass analysers may include: a double focusing sector analyser; an FT-ICR analyser; an orbital trapping analyser; and a Time-of-Flight (TOF) analyser, including multi-reflection TOF.

Preferably the method further comprises performing molecular mass analysis of the sample, so as to provide the mass spectral data. Optionally, the method may comprise determining a minimum resolution for the mass spectral data, based on the identified isotopic mass spectral pattern. Preferably, the method further comprises controlling a mass analyser to perform molecular mass analysis and thereby provide the mass spectral data to achieve at least the determined minimum resolution. In particular embodiments, this may include the step of performing molecular mass analysis being carried out to achieve at least the determined minimum resolution. In this way, the desired resolution that may depend upon the element or element combination that is to be investigated and other (possibly interfering) elements present in the sample can be established before the molecular mass analysis of the sample is carried out. Then, the molecular mass analysis of the sample may be carried out in accordance with the determined minimum resolution.

Advantageously, the method further comprises repeating the steps of comparing and determining for each of a plurality of samples, so as to provide a plurality of measures of abundance for the element or element combination, each measure of abundance being for a respective sample from the plurality of samples. In the preferred embodiments, the plurality of samples are generated by one of: chromatography (gas chromatography, liquid chromatography, ion chromatography or supercritical fluid chromatography, for example); and imaging ionization (for instance, using MALDI or SIMS). Beneficially, the plurality of samples are generated at one or both of: a range of different times; and a range of different spatial positions (which may include two dimensional and three dimensional positions, for example with a depth profile). In most such cases, the plurality of samples will be generated at a range of different times, even if they relate to a range of different spatial positions.

The invention can be especially useful for identifying all substances in a mass chromatogram (or similar technique in which a plurality of samples are analysed) that contain a certain element or element combination. Existing techniques are focused on the total molecule and limited to analysis of the complete elemental composition of the molecule (or MS/MS fragment). This new technique avoids the need to know the complete elemental composition in order to identify the element or element combination across multiple molecules present in the same sample.

In particular, determining a measure of abundance may help to answer two questions: finding all components in the chromatographic run that contain some specified fine isotopic pattern which may include for example the presence of a number of atoms of S, N, Cl, O, etc. or the presence of a specific fine pattern from some combination of said example atoms (such as 1 Cl and 2 S); and from the measured isotopic pattern and the fine structure, the reverse can be applied, such that the same tolerances and calculations outlined can be used to determine how many of such atoms (S, Cl, N, O, etc) are contained in any component.

The invention preferably uses an isotopic fingerprinting technique (comparing the isotopic mass spectral pattern with mass spectral data). This technique can be implemented in a variety of ways. In some embodiments, the step of comparing comprises identifying one of the peaks of the mass spectral data as a principal peak. The principal peak is typically the most abundant, but need not necessarily be so. In some cases, it may be the peak with the lowest mass. Preferably, this step further comprises: for each isotopic variant from the isotopic mass spectral pattern, identifying a respective variant peak of the mass spectral data having an intensity relative to that of the principal peak and mass-to-charge ratio difference from that of the principal peak that correspond with the expected abundance and the expected mass-to-charge ratio difference of the respective isotopic variant from the isotopic mass spectral pattern. Then, the principal peak and each of the respective variant peaks may define a peak group from the plurality of peak groups. The peak group may therefore be considered as matching the isotopic mass spectral pattern (fingerprint).

It should be noted that existing isotopic pattern searches have generally been limited to "rough" patterns arising from highly abundant species such as $^{35}Cl/^{37}Cl$ and $^{79}Br/^{81}Br$, which are strong enough to be resistant to the contributions to intensity from lower abundance heavy isotopes of sulphur, carbon, oxygen, nitrogen, etc. for small molecule applications. The invention makes use of the ability of very high resolution accurate mass data to separate the contributors of the isotopic pattern and observe them individually. The invention provides a means to search for very specific elemental compositions previously unavailable. Specific details of the method for determining a match (correspondence) in embodiments are now discussed.

In embodiments, the intensity of the variant peak relative to that of the principal peak is identified as corresponding with the expected abundance of the isotopic variant when the relative intensity of the variant peak and the expected abundance of the isotopic variant are equal or differ by no more than a predetermined variation. Preferably, the predetermined variation is established by measurement of the variation of signals within the mass analyser that provided the mass spectral data. The measurement of an ion signal may vary from scan to scan, as a result of measurement variation of signals within the mass spectrometer arising from sources such as ion flux from the source and detector response. This variation in measured intensities of individual signals may affect the fingerprinting match by moving the measured intensity away from that expected by the spectral pattern. The predetermined variation is a tolerance value allowing a small window of variation around each observed intensity.

Additionally or alternatively, the mass-to-charge ratio difference from that of the principal peak is identified as corresponding with the expected mass-to-charge ratio difference of the isotopic variant when the mass-to-charge ratio difference of the variant peak and the expected mass-to-charge ratio difference of the isotopic variant are equal or differ by no more than a predetermined tolerance. The predetermined tolerance (which may be measured in parts per million, ppm) may allow for a small variation in measured mass. Preferably, the predetermined tolerance is a function of the mass to charge ratio of the principal peak and a constant tolerance value, more preferably a product of the predetermined mass and the constant tolerance value. Other factors optionally also contribute to the predetermined tolerance.

In some embodiments, the step of comparing further comprises determining a signal-to-noise ratio for the peak group. Then, the step of comparing may further comprise establishing an expected signal-to-noise ratio for each isotopic variant from the isotopic mass spectral pattern, by combining the signal-to-noise ratio determined for the peak group with the expected abundance of the respective isotopic variant. In this case, the step of identifying a respective variant peak of the mass spectral data may be dependent upon the expected signal-to-noise ratio for the isotopic variant corresponding with the variant peak being at least a threshold value. Optionally, the threshold value is 1. Ignoring peak groups with a low signal-to-noise ratio avoids error, such that the determined measure of abundance may be considered a minimum level.

Beneficially, the step of determining the measure of abundance comprises combining an intensity measurement for one or more of the variant peaks of each peak group from the plurality of identified peak groups. This can allow the determined measure to reflect all peak groups identified across the mass spectrum. In the preferred embodiment, the step of combining comprises summing the intensity measurement for one or more of the variant peaks of each peak group from the plurality of identified peak groups.

Optionally, the step of combining comprises: determining a weight for each identified peak group, the weight being indicative of how many of the element or element combination are present in a molecule of a compound corresponding with the identified peak group. The number of elements or element combinations present in the compound may be determined and this can be used as the weight for the one or more peaks of the identified peak group accordingly. A peak group can optionally have more than one weight, each weight being specific to a respective peak of the peak group.

In such cases, the step of combining may further comprise: multiplying the intensity measurement for one or more of the variant peaks of each peak group from the plurality of identified peak groups by the weight determined for the respective peak group. Preferably, the step of combining further comprises: summing the intensity measurements multiplied by the weights.

Additionally or alternatively, the method further comprises: multiplying the weight determined for each of the plurality of peak groups by a nominal mass for the element or element combination. Then, the method may further comprise: establishing a probability level for the peak group based on the mass-to-charge ratios for peaks of the peak group and the weight multiplied by the nominal mass for the peak group. Advantageously, the method further comprises determining any peak groups for which the established probability level is below a threshold. Then, the step of combining may not combine any intensity measurements for those peak groups for which the established probability level is determined as below the threshold. This may allow identified peak groups that are clearly in error to be discarded (those for which the mass-to-charge ratio of the peak is less than the nominal mass determined for the element or element combination present supposedly in the molecule corresponding with the peak).

In some embodiments, the mass spectral data may be generated using tandem mass spectrometry or using MSn, which may come from all ion fragmentation or may be triggered in response to a previous detection of a specific element during acquisition of the mass spectral data. Optionally, the method may further comprise: identifying an elemental composition, structure or both.

In embodiments, the method may further comprise: comparing the determined measure of abundance with one or more of: a determined measure of abundance for a control sample; and a determined measure of abundance for other elements of a time series of samples. A time series of samples may be samples collected from the same individual or pool at different times after administration of a pharmaceutical.

In a further aspect, there is provided a computer program, configured when operated by a processor to carry out the method as described herein. This may be implemented using any form of control logic, digital logic, programmable logic or other processing technology. The computer program may be used to analyse existing mass spectral data, for example. Additionally or alternatively, control of a mass spectrometer (or just part thereof) may be possible using the computer program.

In another aspect, the invention provides a mass spectrometry system, comprising: a mass analyser, configured to provide mass spectral data for a sample; and a processor, configured to carry out the method as described herein using the mass spectral data provided by the mass analyser. It will be further understood that apparatus or structural features configured to carry out any of the method steps described herein may also be provided.

Moreover, a combination of any particular features from within one aspect or between aspects is also provided, even if not explicitly disclosed.

BRIEF DESCRIPTION OF THE DRAWINGS

The invention may be put into practice in various ways, one of which will now be described by way of example only and with reference to the accompanying drawings in which.

DETAILED DESCRIPTION OF A PREFERRED EMBODIMENT

Figure 1:
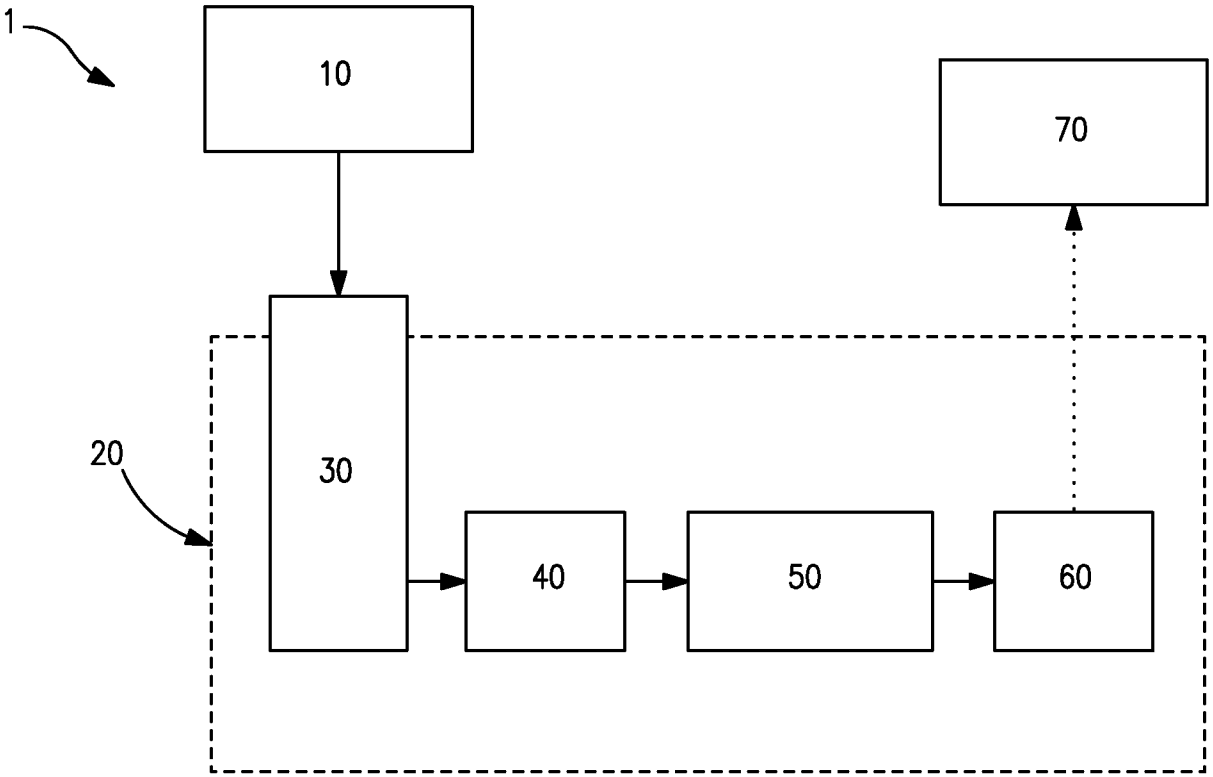
FIG. 1 shows a schematic diagram of an exemplary known system, using which an embodiment of the present invention may be implemented.

Before providing a specific practical example for the operation of an embodiment of the invention, an embodiment of the invention is first described in general terms. The invention uses a mass spectrometer, which typically comprises: an ion source; a mass analyser; a detector; and a processing system. The processing (computer) system receives a detector output and uses this to generate a mass spectrum. The processing system normally also controls the mass spectrometer. The invention concerns the processing (and generation) of the mass spectral data used to provide a mass spectrum.

Embodiment Overview

Before the process begins, an analysis target is defined by the user (or a calling software package operative on the computer system). This is collection of information about the presence and quantity of a certain element or combination of elements. The element may, for example, be sulphur or chlorine.

In a first step, the isotopic signature for that single element or combination is determined. For simplicity, the remainder of this disclosure will focus on the case where a single element is selected, but it will readily be apparent that this can be extended to cover a combination of elements. The exact mass spacing for the isotopes of the target element are determined. Additionally, the isotope ratios are determined for later use. These may be determined based on stored look-up tables, calculated or otherwise established.

In a second step, the mass spectral data is searched for peaks spaced at the determined exact mass difference. For example, these are: a so called "monoisotopic" peak (a principal peak, sometimes also called "M" or "$A_0$"); and a certain exact mass part of an "M+x" (or $A_x$) peak (where x is a number), at a nominal mass that is x more than M, but which should exactly match the mass spacing determined in the first step. The exact mass difference (which is about an integer for singly-charged ions and, for doubly charged ions is either an integer or half an integer) is element dependent. For sulphur, this may be the "M+2" (or $A_2$) peak, for instance.

The monoisotopic peak is normally the peak that has the lowest mass within the isotopic cluster of the compound. This peak may only contain the lightest isotope of all elements in the compound and therefore no further peak belonging to the same compound is expected at that (nominal) mass.

Identifying peaks at the M+1 and M+2 positions is not normally as easy as for the monoisotopic peak. A typical organic compound (dominated by the presence of Hydrogen, Carbon, Oxygen and Nitrogen, depending on compound class in approximately that order of number occurrence) may have several different isotope compositions at the M+1 and usually even more at M+2 and higher order peaks. Even an extremely simple substance like methane ($CH_4$) may already have two signals at M+1, one representing $^{13}C^1H_4$ (m/z=12 17.0341) and one representing $^{12}C^2H_1{}^1H_3$ (m/z=17.0370).

Thus, the mass spectral resolution required to observe the second peak without interference from other masses for an average compound at the same mass is preferably determined as well. This resolution may depend on the mass and the pool of elements considered, as well as on the target element. Optionally, the resolution is determined before data acquisition or during data acquisition, such that the desired analysis can be possible from the recorded data. Typically, a minimum resolving power is determined and the spectrometer is operated to provide at least such a minimum resolving power across a mass range of interest. This may avoid the requirements of precisely knowing a resolving power in advance and of precisely controlling the spectrometer to operate at that resolving power.

In a third step, a generalized abundance quantity is determined from the found peak pairs. The calculated quantity is not necessarily relative to a certain single substance, but rather to a certain element or combination (group) of elements. In the simplest case, such mass quantity is created by just adding all peaks matching the distance criterion from a spectrum. This can be extended for multiple spectra, each spectrum resulting in a mass quantity. The multiple spectra may be generated using the output of chromatography or result dataset of imaging mass spectrometry. Then, the individual mass quantities can each form one point of a trace. The mass quantities forming the trace can be selected from all spectra or from a selection of spectra (for instance, only spectra acquired with a certain setting, such as a certain mass range, a certain fragmentation method or energy, a certain polarity, etc.). This trace can be plotted against time (for the chromatography example), to provide an element or element combination trace, such as a sulphur trace.

Some optional, additional parts to the embodiment may include the following.

1. The isotope ratio of the (at least) two peaks used for extracting data are evaluated to: (a) determine the number of elements present in the compound and weight the data accordingly (for instance, with a weight, w, equal to the number of elements); and/or (b) perform a consistency check on the data. Using the sulphur example, after finding an $A_2$-peak with 9% of the intensity of the $A_0$-peak, data evaluation software could determine a weight of w=2 and multiply the intensity of the peak pair by 2 before adding it to the intensity from the other peaks in the same spectrum. Additionally or alternatively, when finding an $A_2$-peak with 120% of the intensity of the $A_0$-peak, the probability, p, of having that many sulphur atoms (say, 20) in a molecule with mass $A_0$ is determined. In this case for example, p=0 for all masses below 640, and a peak of a mass lower than this value could be considered as faulty and disregarded for construction of the sulphur trace.

2. When more than two peaks could be used for evaluation (for example, M+0.99939 and M+1.99580 for sulphur), the second peak or second and further peaks could be used for consistency checking and correction.

3. In addition or alternatively to displaying a sum of all element (or element combination) intensities found, the display may be annotated with the underlying information.

For instance, a chromatogram or image may have peaks (that is, local maxima) annotated with, for example, the number of masses in the spectrum contributing to the intensity of the peak, the number of elements (such as sulphur atoms) in that peak, the most likely elemental composition of the isotope pattern containing the mass spectral signal contributing to the peak (see for instance EP-2 128 791), a link to the underlying mass spectrum or mass spectra, the interpolated time of the maximum in the trace, co-eluting substances, etc. The display may be interactive, requiring the user to, for example, hover a mouse pointer over the data or mark a region.

4. Mass spectral peaks belonging together and to the pair that was found using the element criterion could be extracted, for example using the method described in EP-2 322 922.

5. Other optional activities may include: smoothing of the extracted element (or element combination) trace; removal of outliers; and automatic creation of "standard traces" (such as S, Br, Cl).

The following point should be noted. By relying on the exact mass pairs, the complete collection of all isotopes belonging to a substance is implicit. Any elution time or heuristics based on a "likely pattern" is purely optional. For example, for a $^{13}C^{32}S+^{13}C^{34}S$ pair, the same logic applies as for the "original" $^{12}C^{32}S+^{12}C^{34}S$ pair. Both will be extracted, provided they have sufficient signal-to-noise levels.

Two approaches exist for dealing with elemental abundances. In a first approach, two occurrences of an element in a compound are treated separately from a single occurrence. For example, the pattern for compounds comprising a single sulphur atom ($XS_1$) is searched for separately from the pattern for compounds comprising two sulphur atoms ($XS_2$). Similarly, a separate search is carried out for compounds comprising three sulphur atoms ($XS_3$) and so on. This approach may be used to pick all instances of a certain element with particular characteristics. For example, it may be used to find compounds containing exactly one $^{14}C$ or exactly three $^{13}C$. The data is effectively directly filtered by m/z difference to match the prescribed isotope ratio for the element of interest initially. In a second approach, an initial filter step is by mass only in a broader way. Then, the number of the element or element combination of interest in each molecule is then determined. This may be more flexible, but possibly adds complexity.

Thus, the embodiment allows: the use of the fine isotopic pattern available in high resolution and high mass accuracy data to perform more advanced isotopic searches; the use of multiple signals combined for a simultaneous isotopic pattern search; and the ability to search for both natural abundances or artificially induced (stable or radio label) patterns. Also, the classical "isotopic pattern" approach is replaced by a fine structure approach, which specifically considers certain exact mass differences between a first and second peak, using high resolution to search directly for elements by their isotope spacing. The specificity generated by high resolution removes interference from other isobars.

Existing isotopic fingerprinting techniques typically use masses and intensities, but require a complete molecular isotopic pattern to be simulated and compared to achieve a match. In fact, absolute masses have been typically used as opposed to relative masses. However, the use of relative mass differences may be advantageous. For example, a peak of a principal isotope ($A_0$) with another peak at a distance of the difference between $^{14}N$ and $^{15}N$ may clearly signify the presence of nitrogen in the compound. Then, the intensity of the signal at the $A_1$ position (a peak with a nominal mass that is one greater than the $A_0$ peak) may therefore provide quantitative information about the nitrogen abundance. For instance, when the intensity ratio between the $A_0$ and the $A_1$ ($^{15}N$) is different from a tabulated ratio, this may indicate enrichment or depletion or that more than one nitrogen atom is present.

Specific Example Overview

Referring to FIG. 1, there is shown a schematic diagram of an exemplary known system, using which an embodiment of the present invention may be implemented. The exemplary known system 1 comprises a mass spectrometer 20 having an upstream chromatograph 10 and a connected computer system 70 for evaluating the accruing data.

The mass spectrometer 20 is of customary design, comprising: an inlet system 30; an ion source 40 (such as an Electrospray Ionization source); a mass analyzer 50 (such as a double focusing sector analyser, FT-ICR, orbital trapping analyser or Time-of-Flight, TOF, analyser including multi-reflection TOF); and a detector 60 (which may have an inlet slit). Upstream of the inlet system 30 is a device for chromatographic separation 10, for example a gas chromatograph (GC) or a liquid chromatograph (LC). The signals arising on the detector 60 are processed and conditioned by the computer system 70. The computer system 70 also controls the operation of the mass spectrometer 20.

Worked Example

The system described with reference to FIG. 1 may be used to detect the presence of sulphur atoms in samples in the following way.

The first step (as defined above) proceeds as follows.

Step 1.1: Two algorithm parameters are defined: an intensity tolerance as a percentage (Toll), which is the maximum difference between expected and measured intensity of a packet; and a mass tolerance in ppm (TolM), which is the maximum mass deviation between expected and measured mass.

Step 1.2: The theoretical isotope pattern (at infinite resolution) of the element or element combination under consideration (here $S_1$) is calculated. The pattern at infinite resolution is also called the "pattern spectrum". For $S_1$ this pattern spectrum appears as follows (the relative abundance is with reference to the monoisotopic peak).

TABLE 1

| m/z | Relative abundance (%) |
|---|---|
| 31.97152 | 100.0 |
| 32.97091 | 0.80 |
| 33.96732 | 4.52 |
| 35.96653 | 0.02 |

Step 1.3: Calculate the mass differences between the most abundant mass and the pattern packets of interest. The packets of interest are those that are strong enough (over 0.5%) and that are well separated from interfering isobaric ions in the mass spectra (as discussed above). The mass differences and the relative intensities are stored in a table of "expected packets" for later use. The table now looks as follows.

TABLE 2

| Δm/z | Relative abundance (%) |
|---|---|
| 0 | 100.0 |
| 0.99939 | 0.80 |
| 1.99580 | 4.52 |

Step1.4: Optionally, the table is now modified in the following way. All of the packets (peaks) are sorted in descending intensity order and are then provided with indices from 0 to n. This step may allow consistent processing of isotope patterns, where the packet with the lowest mass is not base peak (such as in $Br_2$). Then, the table now looks as follows.

TABLE 3

| Index | Δm/z | Relative abundance (%) |
|---|---|---|
| 0 | 0 | 100.0 |
| 1 | 1.99580 | 4.52 |
| 2 | 0.99939 | 0.80 |

The second and third steps of calculating the Isotope Fine Structure Mass Chromatogram (as defined above) then proceed in the following way.

For each scan of interest (which may be MS1 for precursor spectra or MSn for product spectra) at a Retention Time (RT) of x, a Chromatogram point with RT x and abundance y is determined. The abundance y is calculated using the following algorithm.

1. Set y=0.

2. Iterate through all packets (mass=m, intensity=i, noise=n) in the scan in ascending m/z and do the following for each packet:

2.1 Calculate the mass tolerance, $$tol=m/(10^6*TolM)$$

2.2 Calculate the measured S/N (signal-to-noise ratio) value for that packet, $S/N_{meas}$ 2.3 Calculate the expected S/N value for all packets in the table as follows:

$$S/N_{[index]}=S/N_{meas}*RelInt_{[index]}/100,$$

where RelInt is the relative abundance. For example, a packet with intensity i=12345 and noise n=200 results in $S/N_{meas}$ as 61.725. The table now looks like this.

TABLE 4

| Index | Δm/z | Relative abundance (%) | $S/N_{[index]}$ |
|---|---|---|---|
| 0 | 0 | 100.0 | 61.73 |
| 1 | 1.99580 | 4.52 | 2.79 |
| 2 | 0.99939 | 0.80 | 0.49 |

2.4. If S/N[1] is lower than 1.0, go no further with this packet. Continue with next packet at step 2.1.

2.5 For all rows in the table with an S/N[index]>1.0 do the following. Abundance y is incremented if there is a measured packet within both the mass tolerance window and the intensity tolerance window, that is with m/z between (m+Δm/z[index]−tol) and (m+Δm/z[index]+tol), and with an intensity j between (i−i*(relInt[index]+isv) and (i+i*(relInt[index]+isv), where isv is an intensity variation derived from ion statistics. If these conditions are both satisfied, then increment the abundance y by adding intensity j to y, such that:

$$y=Y+j.$$

2.6 Continue with the next packet at step 2.1, repeating steps 2.1 to 2.5, until all the m/z packets in the scan of interest have been analyzed. In this way, where the signal to noise ratio is above the threshold 1.0, abundance y is incremented with multiple intensities j, where packets in the scan of interest match the pattern packets of interest within the mass and intensity tolerances. Abundance y is then a determined measure of abundance for the element or element combination of interest within the sample. (Note that the S/N[index] in Table 4 is overwritten by the calculation for the next packet, each time the steps are repeated.)

The measurement of an ion signal will vary from scan to scan across a chromatographic peak. This variation is the result of measurement variation of signals within the mass spectrometer which arise from sources such as ion flux from the source, detector response and ion counting statistics. This variation in measured intensities of individual signals affects this algorithm by moving the measured signal away from that expected by relInt (relative abundance). The tolerance value (isv) allows for a small window of tolerance around each observed intensity in much the same way a mass tolerance (measured in parts per million, ppm) allows for a small variation in measured mass.

In practice, the values of Δm/z and relative abundance (relInt) for indices greater than 0 can be provided as user parameters. This may allow for more complex pattern searching or pattern searching on only selected portions of the entire fine isotopic pattern measured. As an example, the entered parameters for a small molecule where the desired pattern to detect is the combined $A_0$ and fine structure signals of $^{34}S$ $A_2$ and 2 times $^{13}C$ $A_2$ could be defined (by a user) as follows.

TABLE 5

| Index | Δm/z | Relative abundance (%) |
|---|---|---|
| 0 | 0 | 100 |
| 1 | 1.99580 | 4.52 |
| 2 | 2.00671 | 1.00 |

Nevertheless, user input is not normally necessary. If sufficient information is available (mass accuracy of the instrument for measurement of relative m/z distances, as opposed to the absolute mass accuracy, which has much stronger dependence on good mass calibration), this is used instead. Thus, the algorithm only requires data of sufficient resolution and accuracy for the measurement of (relatively small) mass differences. It is therefore stable against drift of mass calibration.

User Interface

The algorithm can be implemented by a computer program, having a user interface to allow the user to provide criteria and present results from the mass spectral data. The user interface may have a number of different parts: input of the element to be searched for in the data; setup of the mass spectrometry and chromatography accordingly; extraction of data to find all events containing the element or element combination selected in the search criteria.

Figure 2:
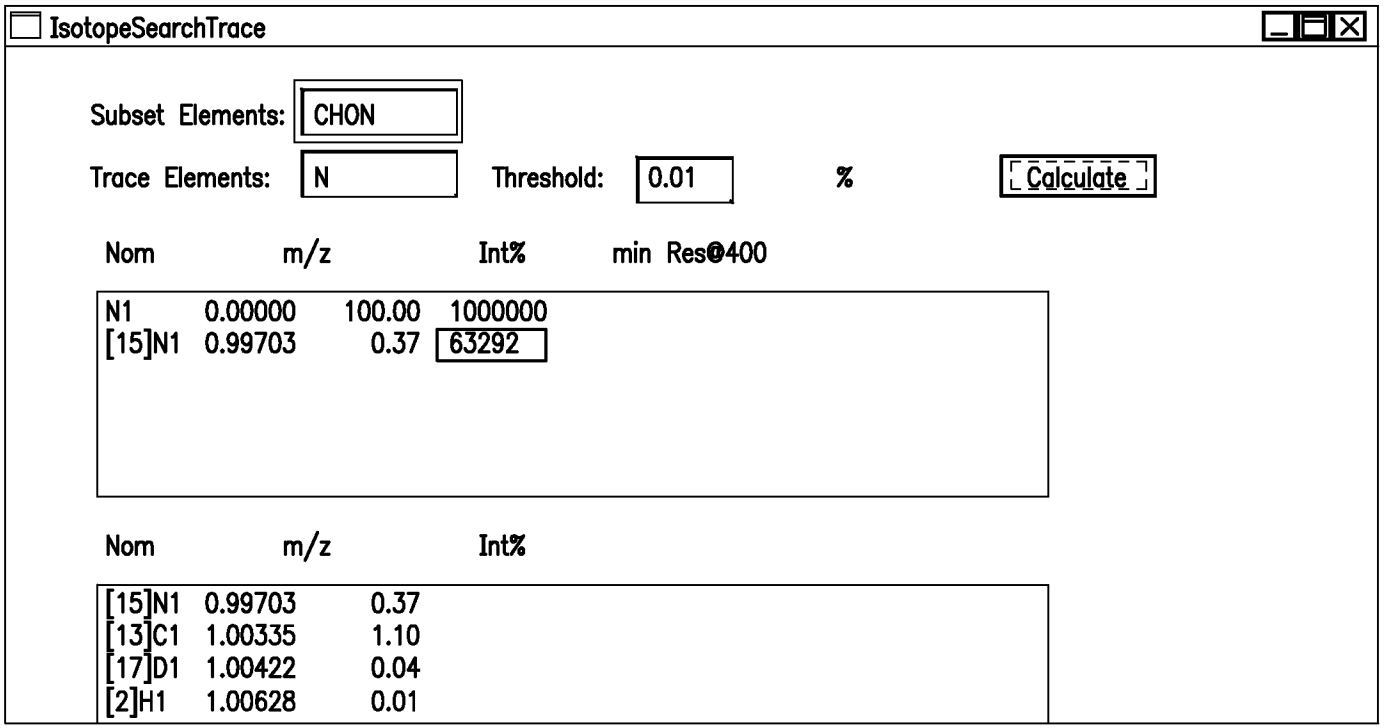
FIG. 2 illustrates one example of a user interface for control of an embodiment in accordance with the present invention.
Figure 3:
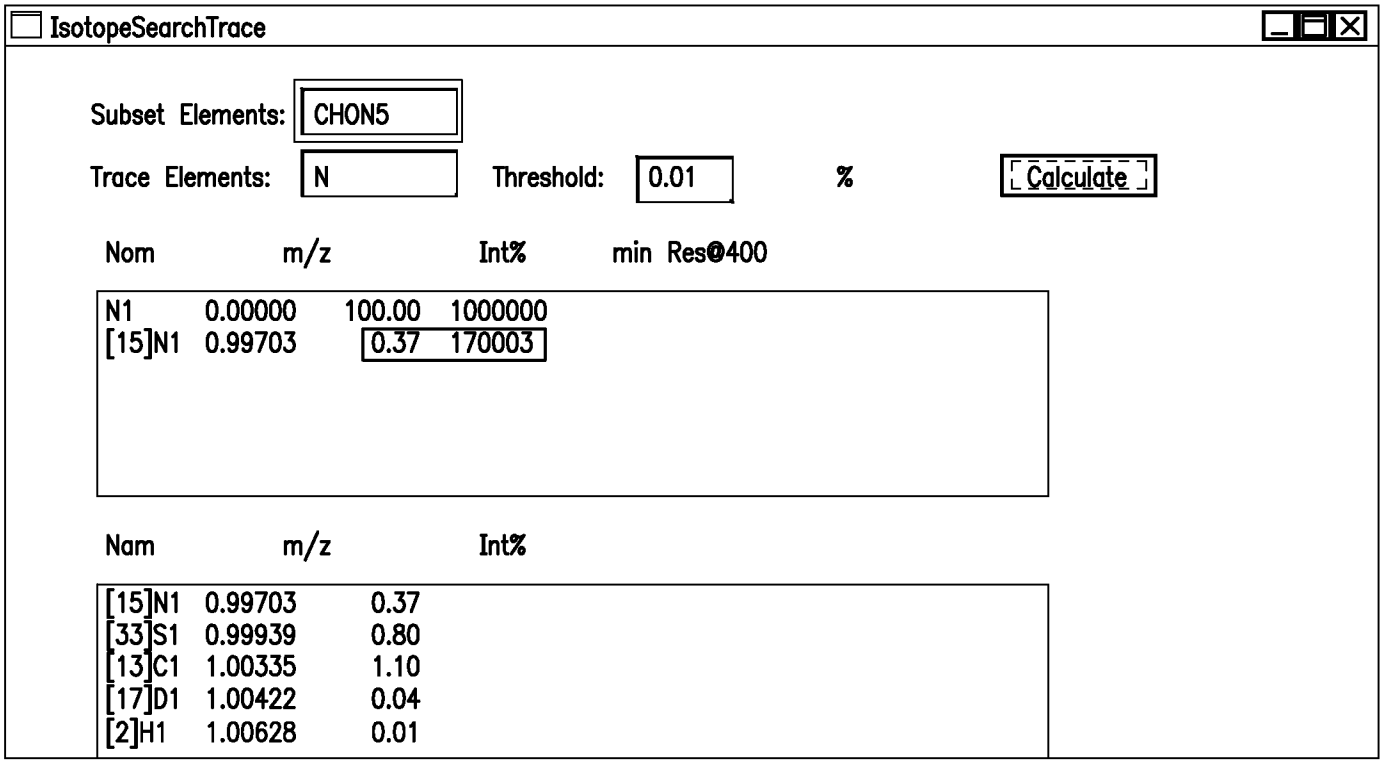
FIG. 3 illustrates another example of the user interface of FIG. 2.

Referring now to FIGS. 2 and 3, there are illustrated examples of a user interface for control of an embodiment in accordance with the present invention. This shows how the resolution can be determined (preferably, predetermined) from a list of expected other elements present in the sample. Resolving Power ("Res" in FIGS. 2 and 3) is provided at m/z 400 and may then be determined from a formula for other masses, depending on instrument type.

Figure 4:
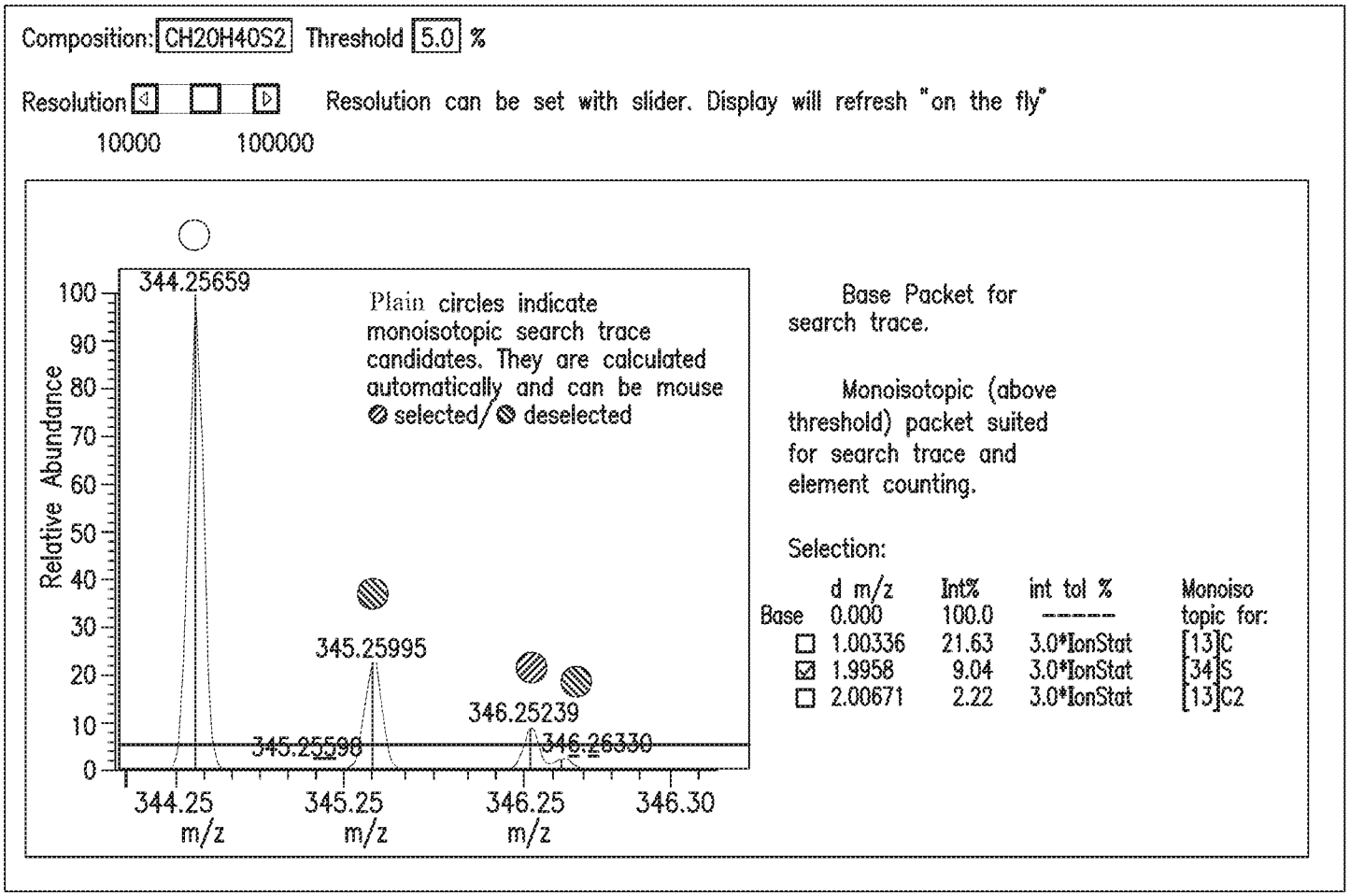
FIG. 4 illustrates a second example of a user interface for control of an embodiment in accordance with the present invention.

Referring next to FIG. 4, there is illustrated a second example of a user interface for control of an embodiment in accordance with the present invention. This shows that the user can specify: the elemental composition; resolution (resolving power); a threshold; and which of the trace candidates to select. Extensions for element counting (the example of FIG. 4 would detect components with two sulphur atoms) may also be provided.

A user-defined formula (such as the pharmaceutical that forms the basis of metabolites to be found) or a selected spectral region by analysis of an elemental composition is used. Using one of these and in view of an available or selected analyser resolution, the system predicts which elements could be resolved and offers them for creation of a "trace". For example, the trace of $^{13}C$ may be of benefit.

Practical Example

Omeprazole ("Omep") is a proton pump inhibitor frequently used in treatment of dyspepsia, reflux, etc. Central to its structure and pharmaceutical mechanism is a sulphur atom. The molecular formula is $C_{17}H_{19}N_3O_3S$.

In this example, sulphur-containing Omeprazole metabolism samples were studied and acquired on High Resolution (HR)/Accurate Mass (AM) LC/MS/MS instrument (specifically, the Q Exactive™ instrument manufactured by Thermo Fisher Scientific, Inc.), which comprises an orbital trapping mass analyser. The resolving power and accurate mass detection from the orbital trapping mass analyser facilitates the identification process using fine isotopic pattern as described above.

Due to the sulphur content of the original pharmaceutical, many metabolites are expected to contain sulphur as well. Thus, a search for all compounds containing sulphur is a useful tool for identifying probable metabolites of Omep. These candidates may then be confirmed by, for example, observing the intensity progression over time in samples (such as blood) collected at different times after administration of a dose. This is made under the assumption that metabolites will first increase and then decrease over time after administration, while most other compounds found are supposed to be constant (unless directly or indirectly affected by the pharmaceutical and its metabolites, but these are likely to show a different time evolution).

Omeprazole in human-dosed urine metabolism samples were collected at 0-3 hr, 3-5 hr and 5-7 hr time ranges. The samples were analysed by the instrument coupled with an Ultra High Pressure Liquid Chromatography (UHPLC) system. LC-MS and MS-MS data were acquired using Full MS scan followed by All-ions fragmentation (AIF) and then (Neutral Loss) NL-triggered data-dependent MS2 at 70,000, 35,000 and 17,500 resolving power, respectively. The UHPLC gradient was 2%/98% ACN/$H_2O$ with 0.1% Formic Acid to 90%/10% ACN/$H_2O$ with 0.1% Formic Acid in 10 min using a C-18 column (2×100 mm, 1.9 um). Data was analyzed to identify S-containing peaks using the algorithm of the above embodiment.

Figure 5:
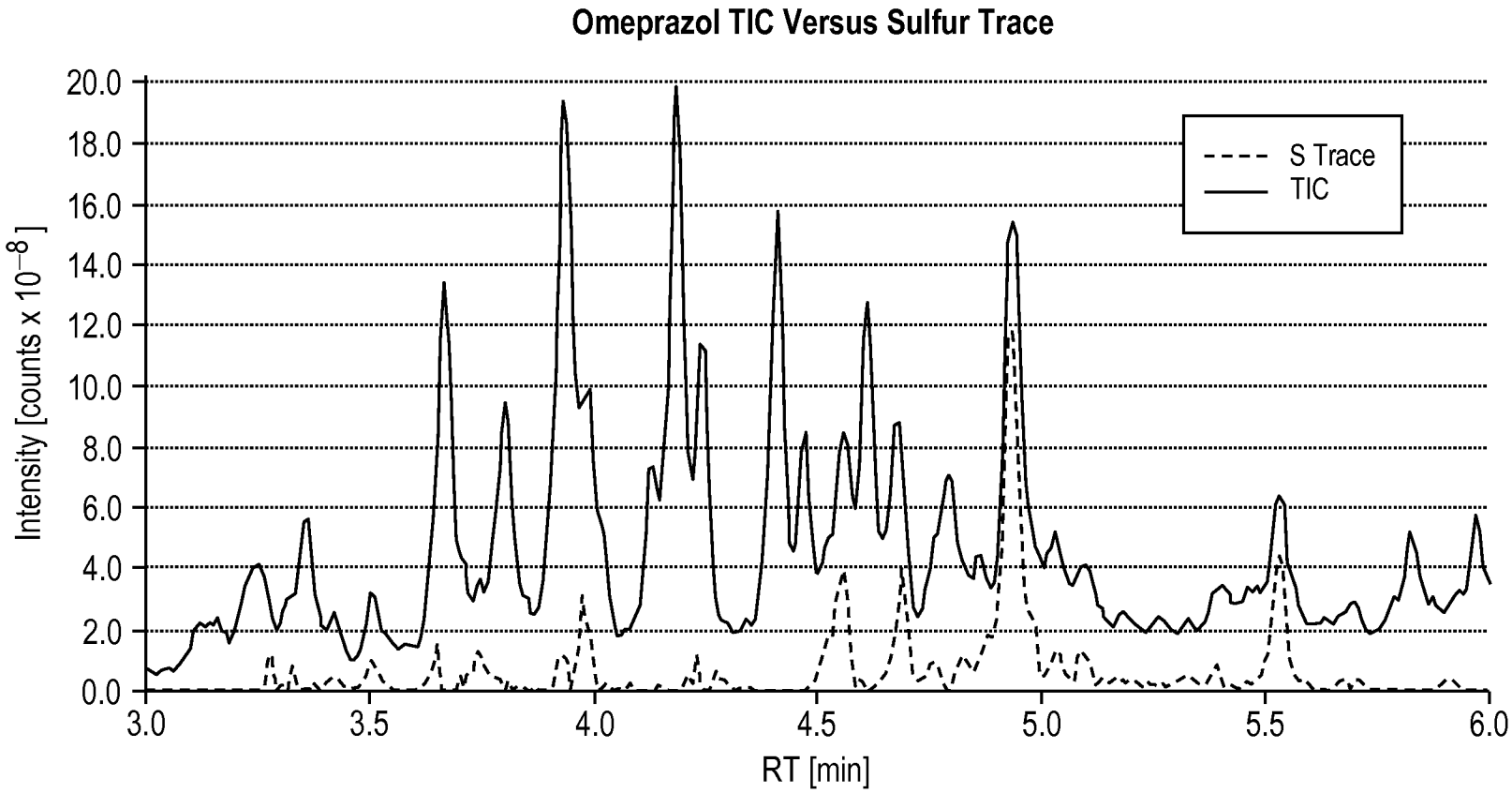
FIG. 5 depicts a first set of example results from an embodiment in accordance with the present invention.

Referring next to FIG. 5, there is depicted a first set of example results from this embodiment. This shows intensity against retention time, for both the total ion current (TIC) and for the sulphur trace generated using the algorithm of the invention. Some candidates for metabolites are visible in the TIC, but some are not. These are all visible in the sulphur trace, however.

Figure 6:
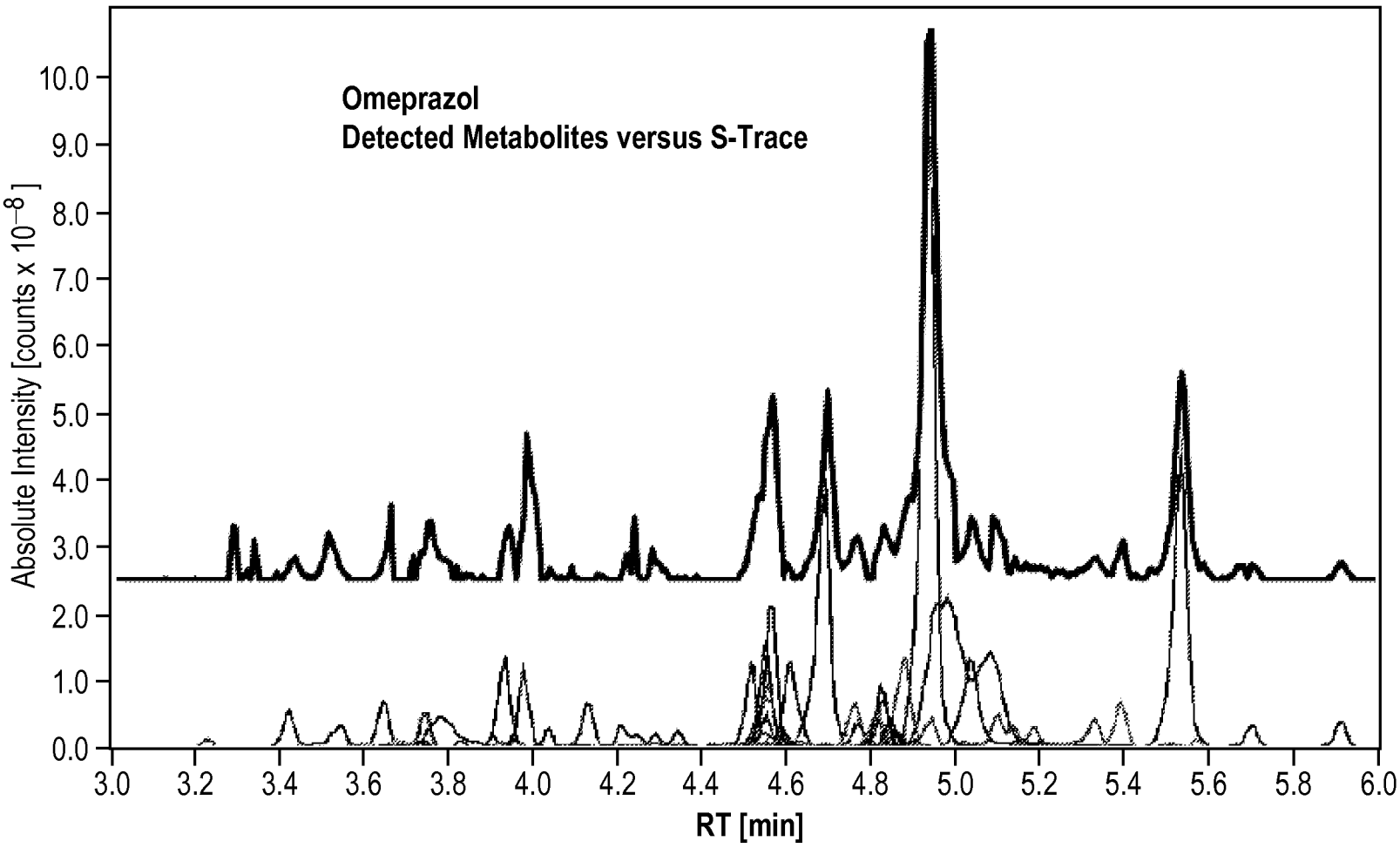
FIG. 6 depicts a second set of example results from an embodiment in accordance with the present invention.

Referring next to FIG. 6, there is depicted a second set of example results from an embodiment. Again, absolute intensity is plotted against retention time. The sulphur trace (in bold) is plotted with expected metabolites in Omeprazole. The Omep system has conventionally been fairly well studied (in the sense that many metabolites are known). FIG. 6 compares the sulphur trace with the extracted mass chromatograms (which may be generated in accordance with a method disclosed in EP-2,322,922) with the known metabolites found in the data. The correspondence can clearly be seen.

In this example, the $A_2$ isotope with one $^{34}S$ and the $A_2$ isotope with two $^{13}C$ in C the full MS scan were well-separated in the data. Using fine isotopic pattern of one S element and the modelling of Gaussian peak shapes according to the selected resolving power of the mass spectrometer instrument, full scan masses were filtered for matches to the fine isotopic pattern. Omeprazole metabolites, sulphate conjugates and endogenous compounds like Urothione were identified using this approach.

Figure 7:
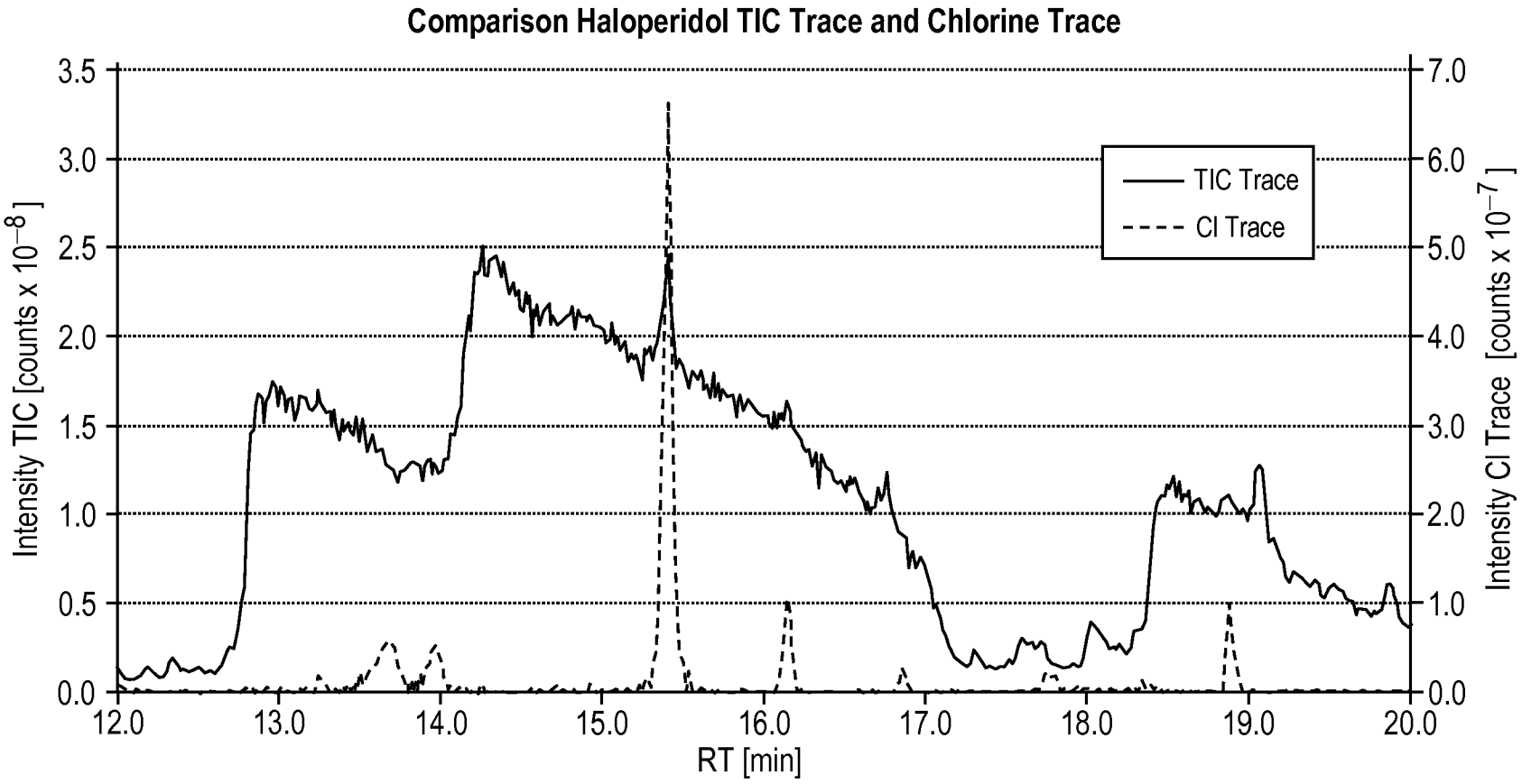
FIG. 7 depicts a third set of example results from an embodiment in accordance with the present invention.

Referring now to FIG. 7, there is depicted a third set of example results from an embodiment. Like FIGS. 5 and 6, this plots absolute intensity against retention time, but for the total ion current (TIC) and for a chlorine trace (generated with a method in accordance with the disclosure above) of the pharmaceutical Haloperidol (HP). HP contains a chlorine atom. Thus, many metabolites are expected to contain Cl as well. As can be seen for FIG. 7, the matrix in this experiment is quite complex, showing just one large area on the TIC plot. On the other hand, the chlorine trace readily identifies a plurality of clear candidates for metabolites. Of these, only the particularly intense one at 15.3 min is visible in the TIC.

For the examples considered in FIGS. 5 to 7 (as well as other embodiments), a typical approach can "qualify" the identified compounds by various methods. For instance, these may include:

a) identifying the elemental composition and structure (optionally using MS/MS data, which may come from all ion fragmentation or may be triggered in response to the detection of Cl or S respectively during acquisition); and b) comparing the result (in the sense of the created element or element combination "trace") with: a control sample; or other elements of a time series (that is, samples collected from the same individual or pool at a range of different times after administration of the pharmaceutical). For example, at a first time (T=0), a first (reference) blood sample may be taken and then a pharmaceutical administered. At a second time (for example, T=30 min), a second blood sample may be taken and at a third time (for example, T=60 min), a third blood sample may be taken. Then, a measure of abundance is determined separately for each sample in accordance with the method performed on each sample and the results are compared. In cases, a potential metabolite identified by a sulphur trace may be excluded from consideration when it is found to be present from the first sample and does not change over time after the subject received the pharmaceutical.

Although a specific embodiment has now been described, the skilled person will appreciate that variations and modifications are possible. For example, it will be appreciated that the invention need not be used as part on an LC/MS system. For example, the invention may also be applicable to imaging mass spectrometry or indeed standard mass spectrometry (in which case, only a single value will normally result from processing the mass spectrum).

The skilled person will also understand that some features are optional and be omitted, or in some cases, replaced. For instance, the resolution need not specifically be set in advance, provided that it is set high enough to allow isotopic variants to be distinguished. Also, some parts of the procedure for identifying elements or combinations based on their isotopes can be changed in cases. The combination of intensity measurements can be made in various different ways. The intensity of all of the identified peaks containing the element or combination can be summed, or just some (for example, not including the monoisotopic peak). Provided that a consistent approach is taken, the result will be comparable with other results generated using the same approach.

The above embodiment does not generally discuss multiple charge states. These are uncommon in metabolomics. However, two approaches are usual for dealing with multiply charged ions. In a first approach, the whole process is repeated considering fractions of the m/z mass difference (for example, ½, ⅓, etc.). In a second approach, a deconvolution is first performed. In other words, calculations are used to multiply all m/z peaks by the charge (z) to obtain a new spectrum where the charge is effectively then always 1.

There are a wide range of possible applications for the disclosed technique. Some of these have been discussed above. Others will now be presented as well.

The invention may provide a new approach to elemental composition analysis. For example, conventional approaches based on "spectral distance" may be replaced with a direct fine-structure based element counting using the disclosed technique. As mentioned above, many elements have a characteristic line pair. The intensity of the $A_1$ (or $A_2$, etc.) lines can then be converted to the number of atoms of that element in a molecule of the compound. For example, this may be an extension of the $^{13}C$-based carbon counting. Whilst this technique is well-known and established, it can be inaccurate in practice, due to interferences from other isotopes, even with data of moderately high resolution.

Another application for the disclosed technique may include control that is dependent upon detection of an element or element combination, for example a trigger on occurrence of a certain element or element combination (such as sulphur) or of a certain quantity of an element or element combination in a molecule of a compound (for example more than three oxygen atoms). When a certain element (or combination) is detected to be above threshold during data acquisition, the instrument control software could change to a specified analysis method. The analysis method (which may be different) could include: performing tandem mass spectrometry (for instance, when sulphur is detected or 3 oxygen or 2 nitrogen atoms are detected); and repeating the mass analysis with a higher resolution, when isobars (peaks at the same nominal mass, but different exact m/z) are not correctly resolved.

The disclosed technique may also be useful in conjunction with All-Ion Fragmentation (AIF). Data can be sought in an MS/MS trace, an element can be detected for precursor or fragment alignment or both. It is common to associate fragments by elution time. Another way of establishing a precursor/fragment relationship may, for example, be to identify an element in a parent ion, by looking at all related fragments for the signature of that element (for instance, sulphur). This may be possible with element combinations too.

In proteomics, the technique may be used in the analysis of cysteine for example. This is an amino-acid containing sulphur. The sulphur atoms of different cysteine units link via S=S binding. In practice theses S=S (sulphur) bridges create analytical challenges, because in many cases only the backbone or the sulphur bond cleaves during a fragmentation event. Thus, less information is available because the molecule as a whole does not seem to fall apart when a "ring" is only opened, but no second cleavage occurs. During acquisition, a higher collision energy, different fragmentation method or special fragmentation scheme (such as ETD plus collisional activation) may be chosen. These events can then later be quickly pulled from the data using the disclosed technique to detect sulphur.

In food or pesticide analysis, searches for elements such as sulphur, chlorine and bromine may be useful. These may be common pesticides and pollutants, such as in dioxins and flame-retardants.

In petroleomics, the identification of sulphur content may be helpful. This may use MS/MS to identify possibilities for targeted sulphur-depletion of the mixture based on functional groups. The sulphur content of a petroleum mixture can be directly evaluated and quantitatively estimated by use of the disclosed technique.

Another application may involve triggering on isotope enriched peaks. This may use MS/MS, as mentioned above. Besides other elements, it may also be possible to identify $^{14}C$-labelled metabolites from so called "micro-dosing" pharmaceutical studies. In such studies, a substance is enriched in $^{14}C$ before administration. Conventionally, the metabolites are then identified using radioactivity detectors, but the $^{12}C$-$^{14}C$ pair may also be observed directly. While the natural abundance of $^{14}C$ (1%) is normally too low for efficient detection by mass spectrometry, enriched peaks may be detectable by means of the disclosed technique.

Quantitation may be performed directly using the abundance measure or trace generated in accordance with the technique. This may require a calibrant though, as discussed above.

A dual acquisition scheme may be used for acquiring the mass spectral data. In this, one "slow" acquisition may be used to provide ultra high resolution and to guide where to look for certain metabolites. A "fast" acquisition may be used for the actual analysis. For example, this may assist in providing a 250000 RP experiment. In that case, only few spectra can be acquired over a chromatographic peak. This may become less of a problem when an additional low resolution analysis is done. In that case the disclosed technique helps to identify regions of interest, which are then evaluated in the high speed data with more detail.

The technique may also be used to correct the use of ion statistical information to set abundance boundaries, avoiding false negatives. Deconvolution of overlapping isotope patterns can also be achieved by identifying possible (or impossible) peak pairs. For example, when two peaks are apart by a distance that cannot be explained, it may be concluded that they belong to different substances.

The technique may be used with various labels and tags, such as Tandem Mass Tags (TMT) and the like. Each unique elemental tag could be pulled, which may provide a quick overview where a TMT or neutron-encoding ("Neucode") label is in the chromatogram. This technique could also be used for metal ion labels, for example as may be found in "sparse" spectra due to their characteristic patterns. In crowded (dense) spectra, the isotope signatures may be difficult to separate from the other information. The fine structure should assist here. Typically, lanthanoides are used. This may give a unique fine shift, which may even be observed at lower resolutions. The mass defects are typically substantial.

What is claimed is:

1. A method of mass spectrometry analysis, comprising:

(a) calculating, for a selected element of interest, an exact mass difference between a principal isotope and a heavier first isotope of the selected element;

(b) calculating, using the calculated exact mass differences and for each of one or more charge states of each one of a plurality of ion species comprising the selected element, an expected difference between a mass-to-charge ratio (m/z) of an $A_0$ mass-spectral peak of said each ion species and an m/z of an $A_1$ isotopic variant mass-spectral peak of said each ion species, wherein the difference corresponds to replacement of one atom of the principal isotope of the selected element by an atom of the heavier first isotope of the selected element within said each ion species;

(c) determining a required minimum instrument resolution necessary to resolve the $A_1$ isotopic variant mass-spectral peak from expected interfering peaks corresponding to isotopic variants of other elements within said each ion species;

(d) acquiring chromatographic mass spectrometry data at or above the required minimum instrument resolution for sample ions;

(e) determining a trace of an abundance of the selected element versus time from the chromatographic mass spectrometry data; and (f) selecting one or more chromatographic peaks in the trace for qualitative and/or quantitative analysis, wherein abundance values of the trace are derived by combining measured intensities only of identified mass spectral peaks within a plurality of peak groups identified from the analyses, each identified peak group corresponding to a charge state of one of the ion species and comprising at least two identified mass spectral peaks that contribute to the combined measured intensities, wherein the identified mass spectral peaks of each identified peak group do not include mass spectral peaks that correspond to an isotopic variant of an ion species that differs from the respective monoisotopic ion species only by substitution of one or more isotopic variants of one or more elements other than the selected element, and wherein the identification of a pair of identified mass spectral peaks of each peak group depends at least on identifying a match between an expected in/z difference, as calculated in step (b), and a measured m/z difference between the mass spectral peaks of said identified pair.

2. The method of claim 1, further comprising:

repeating the steps (d), (e), and (f) for each of a plurality of samples, so as to provide a plurality of measures of abundance for the selected element, each measure of abundance being for a respective sample from the plurality of samples.

3. The method of claim 1, wherein each expected m/z difference is identified as matching a measured m/z difference when the observed and expected m/z differences differ by no more than a predetermined tolerance.

4. The method of claim 3, wherein the predetermined tolerance is a function of an m/z of an $A_0$ mass spectral peak and a constant tolerance value.

5. The method of claim 1, wherein the identification of the pair of identified peaks further depends on identifying a correspondence between an expected ratio of the intensity of the $A_0$ mass-spectral peak to the intensity of the $A_1$ mass-spectral peak and a measured ratio of the intensities of the peaks of said pair.

6. The method of claim 5, wherein the expected ratio of the intensity of the $A_0$ mass-spectral peak to the intensity of the $A_1$ mass-spectral peak is identified as corresponding with the measured ratio of the intensities of the peaks of said pair when the expected and measured ratios are equal to one another or differ by no more than a predetermined variation.

7. The method of claim 1, wherein each peak group comprises at least a third identified peak that contributes to the combined measured intensities, and wherein the identification of the third identified peak comprises identifying a match between a measured m/z of the third identified peak and an expected m/z of an $A_2$ isotopic variant mass-spectral peak that corresponds to replacement of two atoms of the principal isotope of the selected element by two atoms of the heavier first isotope of the selected element within said each ion species.

8. The method of claim 1, wherein the step of combining the measured intensities comprises:

determining a weight for each identified peak group, the weight being indicative of how many atoms of the selected element are present in a molecule corresponding to the respective identified peak group;

multiplying the intensity measurement for one or more of the identified mass spectral peaks of each identified peak group by the weight determined for the respective peak group and summing the intensity measurements multiplied by the weights.

9. The method of claim 1, further comprising:

determining a weight for each identified peak group, the weight being indicative of how many atoms of the selected element are present in a molecule corresponding to the respective identified peak group;

multiplying the weight determined for each of the identified peak groups by a nominal mass for the selected element;

establishing a probability level for each identified peak group based on the measured m/z values of peaks of said each identified peak group and the weight multiplied by a nominal mass for said each identified peak group; and determining any identified peak groups for which the established probability level is below a threshold, wherein the step of combining does not combine any intensity, measurements for those peak groups for which the established probability level is determined as below the threshold.

10. The method of claim 1, further comprising:

selecting a different element of interest; and repeating steps (a), (b), (c) and (e) as pertaining to the different selected element.

11. The method of claim 7, wherein the identification of each third identified mass spectral peak of each identified peak group further depends on identifying a correspondence between an expected ratio of the intensity of an $A_2$ mass-spectral peak to the intensity of the $A_0$ mass-spectral peak and a measured ratio of the intensity of said each third identified mass spectral peak to the intensity of a monoisotopic mass spectral peak of the respective identified peak group.

12. The method of claim 11, wherein the expected ratio of the intensity of the $A_2$ mass-spectral peak to the intensity of the $A_0$ mass-spectral peak is identified as corresponding with the measured ratio of the intensity of said each third identified mass spectral peak to the intensity of the monoisotopic mass spectral peak when the expected and measured ratios are equal to one another or differ by no more than a predetermined variation.

13. The method of claim 7, wherein the step of combining the measured intensities comprises:

determining a weight for each identified peak group, the weight being indicative of how many atoms of the selected element are present in a molecule corresponding to the respective identified peak group;

multiplying the intensity measurement for each of the identified mass spectral peaks of each identified peak group by the weight determined for the respective peak group and summing the intensity measurements multiplied by the weights.

14. The method of claim 7, further comprising:

determining a weight for each identified peak group, the weight being indicative of how many atoms of the selected element are present in a molecule corresponding to the respective identified peak group;

multiplying the weight determined for each of the identified peak groups by a nominal mass for the selected element;

establishing a probability level for each identified peak group based on the measured m/z values of peaks of said each identified peak group and the weight multiplied by a nominal mass for said each identified peak group; and determining any identified peak groups for which the established probability level is below a threshold, wherein the step of combining does not combine any intensity measurements for those peak groups for which the established probability level is determined as below the threshold.

* * * * *